US005490359A

United States Patent [19]

Hepler

[11] Patent Number: 5,490,359

[45] Date of Patent: Feb. 13, 1996

[54] APPARATUS AND METHOD FOR ATTACHING PLASTIC SIDING OR TRIM PIECES TO METAL SHEATHING

[76] Inventor: Jacque Hepler, R.D. 2, Box 87, Hegins, Pa. 17938

[21] Appl. No.: 272,053

[22] Filed: Jul. 8, 1994

[51] Int. Cl.[6] ..... E04D 1/34

[52] U.S. Cl. ..... 52/506.06; 52/520; 52/546; 52/506.05; 52/547

[58] Field of Search ..... 52/500, 544–549, 52/506.05, 506.06, 512

[56] References Cited

U.S. PATENT DOCUMENTS

| | | | |
|---|---|---|---|
| 4,424,655 | 1/1984 | Trostle | 52/520 |
| 4,435,933 | 3/1984 | Krowl | 52/520 X |
| 4,854,101 | 8/1989 | Champagne | 52/520 |
| 4,947,609 | 8/1990 | Champagne | 52/520 X |
| 5,339,608 | 8/1994 | Hollis et al. | 52/547 X |
| 5,392,579 | 2/1995 | Champagne | 52/547 X |

*Primary Examiner*—Carl D. Friedman
*Assistant Examiner*—Beth A. Aubrey
*Attorney, Agent, or Firm*—William J. Ruano

[57] ABSTRACT

In combination, a metal sheathing of a building, a plastic covering sheet, means for properly attaching said plastic sheet to said metal sheathing comprising a metal clip having a top portion folded over the top of said plastic sheet and having a laterally punched out portion extending through said plastic sheet, a weld pin having one end extending through punched out portion of said metal clip, to contact with metal sheathing.

1 Claim, 2 Drawing Sheets

APPARATUS AND METHOD FOR ATTACHING PLASTIC SIDING OR TRIM PIECES TO METAL SHEATHING

BACKGROUND OF THE INVENTION

No satisfactory method is known to properly attach plastic siding or trim pieces to metal sheathing of a building wihout burning the plastic siding or trim.

SUMMARY OF THE INVENTION

The present invention relates to overcoming the above-mentioned problem by pin or stud welding the plastic siding or trim pieces to the metal sheathing with a burn shield to prevent burning the plastic siding or trim.

DESCRIPTION OF THE PREFERRED EMBODIMENT

Figure 1:
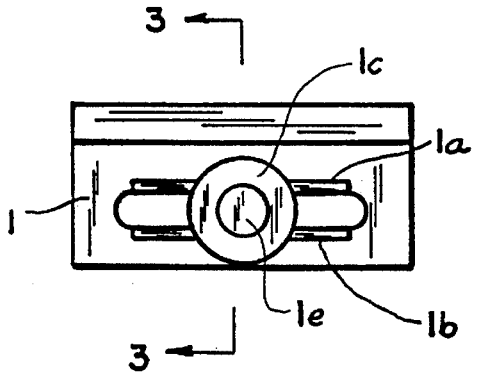
FIG. 1 is a front view of a burn shield embodying the present invention.
Figure 2:
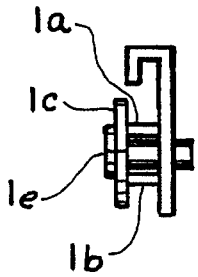
FIG. 2 is a side view thereof.
Figure 3:
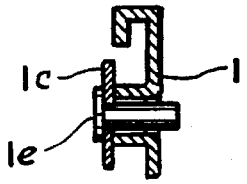
FIG. 3 is a sectional view thereof.
Figure 4:
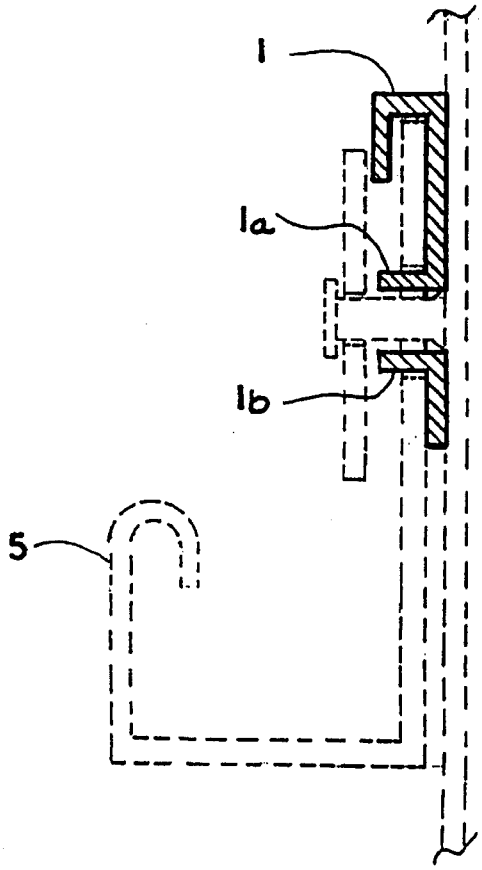
FIG. 4 is an enlarged sectional view thereof taken along line 3—3 of FIG. 1 as applied to a plastic J channel and metal sheathing shown in dash lines.
Figure 6:
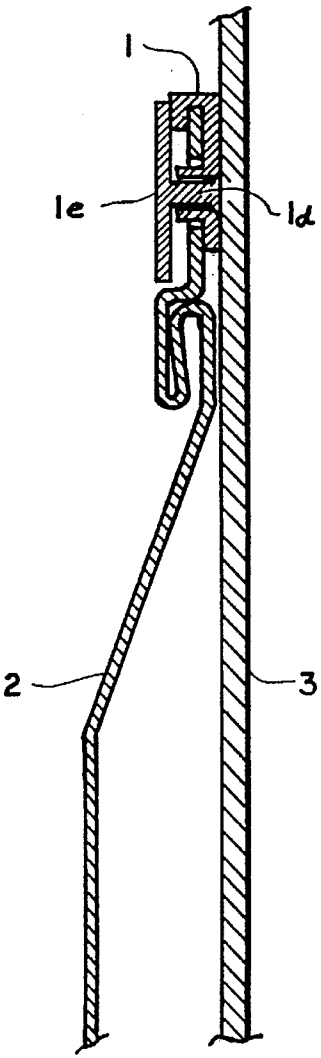
FIG. 6 is a vertical cross section taken along line 6—6 of FIG. 5.
Figure 5:
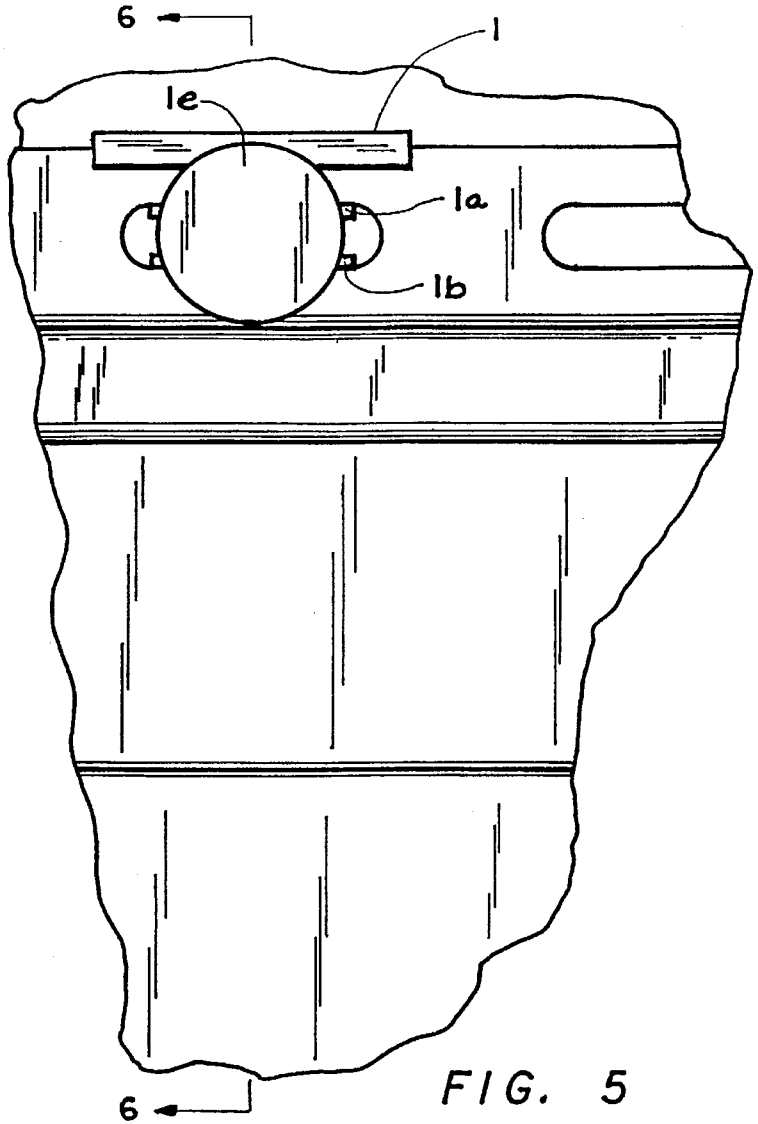
FIG. 5 is front view of the burn shield as applied to welding a plastic siding to a metal sheathing.

FIGS. 1 2, and 3 show a burn shield embodying the present invention comprising a metal clip 1 bent to fold over the top of a plastic J channel 5, as shown in FIG. 4, or to a plastic building siding 2, instead, as shown in FIGS. 5 and 6. The metal clip 2 has laterally punched out portions 1*a* and 1*b* which project through the plastic J channel 5, as shown in FIG. 4, or through plastic building siding 2, as shown in FIG. 6 to form a welded joint.

As shown in FIGS. 5 and 6, the welded joint is formed by a weld pin 1*d* to which a capacitor discharge welder is applied to create weld fastening to the metal sheathing without burning either the plastic J channel (or siding) 5, such as vinyl siding of FIG. 6 which burning would otherwise occur, disfiguring the plastic material.

The metal clip 1 in FIG. 1 shields the back of the siding. Its parts 1*a* and 1*b* protrude through the siding and shield the edges of the slot.

The invention may be a tab, as shown in FIG. 1, or a continuous piece extending throughout the entire length of the siding 2. The tabs shown in FIG. 1 could be applied in the field. The continuous piece could be done by the manufacturer.

The burn shield can also be used as a spacer for screw fastening the siding to the sheathing.

The screw placed through the flanges fastens the siding and allows movement for expansion and contraction.

I claim:

1. In combination, a metal sheathing of a building, a plastic covering sheet, and means for properly attaching said plastic sheet to said metal sheathing, the attaching means comprising a metal clip having a top portion folded over the top of said plastic sheet and having a laterally punched out portion extending through said plastic sheet, and a weld pin having one end extending through said punched out portion of said metal clip, to contact the metal sheathing.

* * * * *